US009199249B2

(12) United States Patent
Nagel

(10) Patent No.: US 9,199,249 B2
(45) Date of Patent: Dec. 1, 2015

(54) SUCTION FLOAT AND COLLECTING DEVICE, AND COLLECTION VESSEL

(76) Inventor: Udo Nagel, Drochtersen (DE)

( * ) Notice: Subject to any disclaimer, the term of this patent is extended or adjusted under 35 U.S.C. 154(b) by 228 days.

(21) Appl. No.: 14/007,031

(22) PCT Filed: Apr. 3, 2012

(86) PCT No.: PCT/DE2012/100088

§ 371 (c)(1),
(2), (4) Date: Sep. 24, 2013

(87) PCT Pub. No.: WO2012/136203

PCT Pub. Date: Oct. 11, 2012

(65) Prior Publication Data

US 2014/0190878 A1 Jul. 10, 2014

(30) Foreign Application Priority Data

Apr. 8, 2011 (DE) ..... 10 2011 001 916

(51) Int. Cl.

| | |
|---|---|
| ***E02B 15/04*** | (2006.01) |
| ***B03D 1/14*** | (2006.01) |
| ***B63B 35/32*** | (2006.01) |
| ***E02B 15/08*** | (2006.01) |
| ***E02B 15/10*** | (2006.01) |

(52) U.S. Cl.

CPC . *B03D 1/14* (2013.01); *B63B 35/32* (2013.01); *E02B 15/046* (2013.01); *E02B 15/08* (2013.01); *E02B 15/106* (2013.01); *E02B 15/047* (2013.01)

(58) Field of Classification Search

CPC ..... E02B 15/046; E02B 15/047; E02B 15/08; E02B 15/106; B63B 35/32

USPC ..... 210/122, 170.05, 170.09, 170.11, 210/242.3, 923

See application file for complete search history.

(56) References Cited

U.S. PATENT DOCUMENTS

| | | | | |
|---|---|---|---|---|
| 3,598,501 | A * | 8/1971 | Stanfield et al. | 210/923 |
| 3,745,115 | A * | 7/1973 | Olsen | 210/242.3 |
| 3,983,034 | A * | 9/1976 | Wilson | 210/242.3 |
| 4,956,100 | A * | 9/1990 | Mikkleson | 210/242.3 |
| 5,059,312 | A * | 10/1991 | Galletti | 210/122 |
| 5,091,096 | A | 2/1992 | Thomas et al. | |
| 5,128,033 | A * | 7/1992 | Eberhardt | 210/242.3 |
| 5,292,433 | A * | 3/1994 | Fletcher et al. | 210/170.05 |
| 5,693,218 | A * | 12/1997 | Yamamoto et al. | 210/242.3 |
| 6,274,047 | B1 * | 8/2001 | Bates et al. | 210/170.05 |
| 7,534,343 | B2 * | 5/2009 | Gomez et al. | 210/122 |
| 7,790,023 | B1 * | 9/2010 | Mills | 210/122 |

FOREIGN PATENT DOCUMENTS

| | | | |
|---|---|---|---|
| DE | 2407409 | A1 | 8/1974 |
| DE | 4336963 | A1 | 7/1994 |
| WO | 2011160645 | A1 | 12/2011 |

* cited by examiner

*Primary Examiner* — Christopher Upton

(74) *Attorney, Agent, or Firm* — Stephan A. Pendorf; Patent Central LLC

(57) ABSTRACT

A suction float (1) for removing liquid and/or foam-like contaminants (22) from surfaces (21) of liquids (2), wherein the contaminants are drawn off downwards from the upper surface (111) of the float via a suction pipe section (12). For this purpose the float (1) has a first duct (13) extending from the upper surface (111) to the underside (112) for the suction pipe section to pass through and a second duct (14) from the underside (112) to the upper surface (111) of the float, wherein after passing through the first duct (13) the suction pipe section (12) is guided along the underside (112) of the float (11) and is designed to penetrate into the second duct (14), wherein the float (11) is movable along the suction pipe section (12). The invention further relates to a collecting device having a suction float (1) and to a collection vessel.

15 Claims, 2 Drawing Sheets

SUCTION FLOAT AND COLLECTING DEVICE, AND COLLECTION VESSEL

BACKGROUND OF THE INVENTION

1. Field of the Invention

The invention relates to a suction float to remove liquid and/or foam-like contaminants from the surface of liquids. Further, the invention relates to a collection device with a suction float and a collection vessel.

2. Description of the Related Art

Contamination on surfaces of liquids could be liquid or foam-like. Examples of contaminants include substances such as oil, crude oil, bound oil, foams, chemicals and contaminants of all types, as well as garbage, wherein the impurities swim or drift on the liquid, for example water or the like in machine holding pools, water reservoirs, settling tanks, ponds, lakes, rivers or oceans.

Seas, lakes or rivers are contaminated and polluted with industrial residues, oils or other wastes. These impurities float to the surface and must be removed. Ponds are contaminated, for example, by leaves or other plant debris. Machine holding pools can include, for example coolant liquids which become contaminated with oil or the like during the working process.

Different arrangements are known from the prior art to remove impurities on the surfaces of liquids.

Standard means for extraction of contaminants from surfaces of liquids include, for example, vacuum pumps which draw large amounts of fluid besides the actual contaminants. Alternatively, absorbents, such as binders or natural fibers, such as cotton, are used in order to bind the impurities for later collection in firmer bound form.

For further treatment of the suctioned-off impurities and liquids, there are known for example oil separators or light liquid separators or even gasoline separators, which deposit the suctioned-off impurities in an appropriate subsequent treatment facility for separation of the impurities from the fluid, thereby to remove the impurities found on the surfaces of liquids.

Next, different arrangements for removing contaminants from the surface of the sea or inshore waters are known in the prior art to combat oil spills and spills of oil rigs or tankers at seas and inshore waters.

Oil floating on the water surface can be skimmed using specialized vessels, folding boats, conventionally designed boats with outriggers, catamarans or mixed constructions with a catamaran bow. For this purpose there is known, for example, in the prior art a double hull vessel "Thor" of which the two vessel halves open from the bow to 65 degrees for receiving oil, whereby an open triangle is formed in which the oil collects. At a low operating speed the oil is forced through openings in the two ship halves, separated by separators, and pump with charge into the cargo tanks. The actual receiving devices may be based on the principle of a dam over which the oil flows, or an oil adsorbent layer with revolving rollers, or brushes with strippers, which gather the impurities.

After skimming, the oil which still contains water is further purified by means of separators, wherein the water is largely removed. For low and high oil viscosities, partially differing pumping systems are used.

Also known generally in the prior art are skimmers. A skimmer is a device in artificial lakes, ponds or pools and other liquid bodies, which sucks the dirt from the surface. Dust, leaves, oil or other contaminants cause the pond or sea water to become enriched with too many nutrients from the outside and thus overgrown with algae and cloudy. A skimmer in a pond or lake prevents this process and can prevent that the surface contamination causes the water to become cloudy. In larger bodies of water a proportionately larger number of water extraction points is installed. Skimmers can also be used, for example, to clean cooling water. Skimmers have a large diameter pipe positioned vertically in the liquid, wherein the diameter of the pipe is greater as it nears the water surface. Via a pipe connection, to which a suction pump is connected and in which a coarse particle filter or a sieve is attached, the skimming off of impurities from the surface of the liquid is accomplished.

Another field of application of appropriate extraction systems is in the industry. To obtain stable cooling lubricants in the machining industry, the required concentrate must be thoroughly mixed with water. Systems are available for the separation of unwanted oils, which can quickly separate the undesirable oils and other contaminants, for example, cutting lubricating fluids, without changing the base fluid. For this purpose suction floats or snorkel floats are used for the extraction, which are arranged in a liquid reservoir.

DE 3916026 A1 discloses an apparatus for collecting gasoline, oil and similar materials floating on the water, the apparatus comprising a dam made up of floating bodies and having a skimmer connected to a pump. Box-shaped wall elements form the floating body, which sink to approximately half their depth in the water and have a tall elongated rectangular cross-section shape. For the form-stable connection of the individual wall elements, plug-in elements are provided at both ends.

Further, an apparatus for removing floating substances such as oil, foam, and the like is known from DE 2407409 A, wherein a main floating body having through-channels for receiving floating substances is provided, with a buoyant housing or buoyant structure, wherein the buoyant housing or structure is movable up and down relative to the main floating body. By means of this device oil, foam and the like, for example, floating on the water of rivers, lakes, the sea water, of liquid surfaces in settling tanks, water tanks and the like can be removed.

Problems of the known prior art suction devices:

With known deep-sea systems, the efficiency of present systems is already very limited in rough seas of 1 meter wave height, and from 2 meters they are no longer useful. This means they can be employed to a maximum wind force 4. Since the impurities must however be removed even in stronger winds, this needs to be improved. Similarly, the use of speed is limited to 1 to 2 knots. The collecting widths are, in the larger vessels, up to 40 meters.

In other application areas, such as industrial plants or other aquatic bodies, adaptability to changing liquid levels is relatively difficult, so mostly a manual adjustment is required.

BRIEF SUMMARY OF THE INVENTION

The present invention has for its object to provide an arrangement that makes it possible to remove liquid and/or foam-like impurities from surfaces of liquids, wherein an automatic self-adaptation to changing liquid levels occurs. This change in liquid levels may be due to rising or falling liquid levels or even waves. During suction of the impurities only small amounts of fluids should be transported away, such as the further processing may be designed extremely efficient, since only small amounts of fluids are present which need to be separated.

A suction float includes a suction pipe section for transporting aspirated liquid, a floating body with an upper surface and an underside, a first duct from the upper surface to the underside for passage through of the suction pipe section and a second duct from the underside to the upper surface, wherein the suction pipe section after passage through the first duct is guided to the underside of the floating body, and is formed to penetrate into the second duct, wherein the float is movable along the suction pipe sections, and enables removal of liquid and/or foam-like contaminants from the surfaces of liquids.

Such a suction float is itself capable of adapting to changing liquid levels since the float, preferably the upper surface of the float, is located just at the surface of the liquid surface.

The mentioned floating body is to be understood to include not only a hollow body with an appropriate buoyancy, but also floating bodies with a different filling, for example, of plastic or other materials, or even only one material without a body cavity. The body must be configured such that it floats on the surface of a liquid and for this purpose must have corresponding buoyancy.

Such a suction float can be used for the applications mentioned in this application. These include inter alia emulsion containers on machine tools, small degreasing systems, sewage treatment modules, CNC metal machining, surface treatment, wastewater treatment plants, as well as on lakes, ponds, waterways, port facilities or the ocean. Of course, other applications where surface impurities must be removed are conceivable.

The liquid and/or foam-type impurities to be removed from the surface of the liquid are directed along the upper surface of the floating body into the second suction pipe section and transported away from there. For this purpose, for example a pump is arranged, which sucks the impurities.

With changes in the level of liquid the float moves automatically on the surface of the liquid always corresponding along with the surface, so that only minimal amounts of fluid are removed. Thereby a particularly efficient removal of contaminants is possible, because subsequent to removal the extracted impurities hardly contain the liquid as component.

By guiding the suction pipe sections in the first and second passage, movement is possible, namely a floating of the floating body according to the liquid level or height without any twisting or tilting of the floating body. Drifting away of the floating body is also efficiently prevented.

The portions of the suction pipe sections are to be selected so that, for a maximum upward floating movement of the floating body along the suction pipe sections, the suction pipe section does not depart from the second passage, so that at least the end of suction pipe section always penetrates in the second passageway.

Since the outer diameter of the suction pipe sections is less than or equal to the inner diameter of the first and/or second passage, a low friction or friction-free floating movement of the float along the suction pipe sections possible.

If the seal between the first and/or second passage and the suction pipe section is formed as a hydraulic seal or a sealing ring, on the one hand only a small amount of fluid is sucked up from the bottom of the floating body, and on the other hand, there is no mixing of the contaminants with the liquid by passage through during the continuous adjustment and adaptation of the floating body to the fluid levels or height.

In order to limit the free movement of the floating body, a stop is provided on suction pipe section. Depending on the application, this can allow a sufficient stroke without however allowing floating too high.

Since a baffle plate is provided at the suction pipe section which is at least partially protective, arranged preferably upstream in the operating direction and/or about the floating body, in case of excessive feeding rate and at high relative speeds the pressure is relieved from the floating body, so that the liquid flows around the baffle plate and will subsequently indirectly impinge on the floating body. The baffle prevents tilting of the floating body.

The baffle can for this purpose be arranged either below the surface of the liquid or above the liquid surface, or above and below the surface of the liquid. The height should be so selected, that not too much flow resistance is given and that adequate protection is given against the pressure of the liquid.

When the upper surface of the buoyant body is funnel-shaped, the liquid and/or foam-like impurities can be guided into the second passage.

Additionally or alternatively, at the upper surface, a rim is arranged, which preferably has notches and/or indentations, so that only a certain amount of impurities per unit time reaches the float.

The collection device comprises a suction float with a suction pipe section transporting aspirated liquid, a floating body having a upper surface and an underside, a first passage from the upper surface to the underside for passage through of the suction pipe sections and a second passage from the underside to the upper surface, wherein the suction pipe section after passage through the first passage is guided along the underside of the floating body, and is formed penetrating in the second duct, wherein the floating body is moveable along the suction pipe sections, a suction pipe for the transport of extracted impurities and/or liquids, a mount for attaching, and a suction device and/or separator, wherein the liquid and/or foam-like contaminants on the surface of the liquid are sucked through the suction float by the suction device and/or are separated with the aid of the separation device, allowing the collection of liquid and/or foam-like impurities surfaces of liquids. In this way an efficient collection device is provided to remove contaminants from a surface, and in particular to more efficiently separate the residues of the liquid, so that only a small residual liquid is present in the contaminants.

Separators to meet varying needs include screens, oil separators, light liquid separators, etc. A particularly suitable separator comprises as the last stage a coalescence separator. Such a coalescence separator consists of V-shaped sheets, which are arranged like roofs above one another. Through holes at the bending edge the smallest dispersed liquid droplets of contaminants coalesce into larger droplets with more buoyancy and can be removed at the surface of a last stage by the density difference.

By providing guide means for feeding the liquid and/or foam-like contaminants on the surface of the liquid to the suction float, preferably two baffles passing through the surface of the liquid, an efficient delivery is ensured. With the help of the guide baffles extending through the surface of the liquid, a significantly larger surface is processed.

This enlargement of the work surface can be further improved, for example, on the high seas, if an additional tug with appropriate inflatable barriers cruises ahead of the special ship, wherein the barriers serve as an extension of the baffles.

The suction float is held in the liquid in the collecting device by the suction pipe. This suction pipe is attached and mounted via a bracket on a container, edge, ship or corresponding object. As a special design, the suction float can be tilted up and held in this position for transport and/or maintenance. This is effected by pivoting of the suction pipe, which is correspondingly formed with supporting or strengthening.

It is possible to remove liquid and/or foam-like impurities, such as oil or the like, from the surface of the sea or water surface efficiently using a collection vessel comprising a collecting device with a suction float, a suction pipe section for transporting aspirated liquid, a floating body having an upper surface and an underside, a first passage from the upper surface to the underside for passage through of the suction pipe sections and a second passage from the underside to the upper surface, wherein the suction pipe section after passage through the first passage is guided along the underside of the floating body, and is formed penetrating in the second passage, wherein the floating body is moveable along the suction pipe section, and a suction pipe for the transport of extracted impurities and/or liquids, a support for mounting and a suction device and/or a separator, wherein the liquid and/or foam-like contaminants on the surface of the liquid are sucked through the suction float by the suction device and/or are separated in the separation apparatus, wherein the suction float is secured to the vessel preferably by a fastening and/or mounting the suction pipe on the deck of the ship and/or the ship's hull. In particular, this is possible even with fluctuating water levels and/or waves.

In the case that two baffle plates are provided passing through the surface of the liquid, connected to a common fastening point, preferably an adjustable support fixable to the hull, in such a way that they form an at least approximately V-shaped arrangement with an angle open in the direction of the operating mode, with the suction float arranged in the center of the two guide plates, wherein a baffle plate is preferably disposed on the side of the suction float opposite the side of the fastening point, the efficiency is improved in the case of higher wave action. By providing the baffle plate with appropriate dimensions directly or with a slight distance to the float, a good protection against excessive water pressure is achieved.

Further embodiments are comprised of a particular combination of components into units:

A first unit represents the suction float having as a transfer point for the transition from the suction pipe section to the suction pipe. This first unit can be easily handled and transported.

A second unit in this context comprises the combination of suction pipe in communication with the suction device and/or the separator, at least one first separator.

A third unit in this context constitutes means for increasing the working surface with the baffles and a corresponding support for a ship's hull or the like These three units can be provided in readiness in larger numbers, preferably by means of sea containers, and accordingly transported to the job site when needed. There vessels of any size can be equipped with an appropriate collecting device, and start with the removal of impurities such as oil or the like. This provides a way to quickly access different locations, where the available resources, namely the ships on site of different configuration can be used for the control of impurities by adapting the corresponding universal and adjustable brackets, adapters and fittings and fixtures to the particular vessel forms.

For this purpose, further, a mother ship is employed, provided with a plurality of individual small boat units of appropriate design, that start the removal of impurities in a disaster area. For this purpose, particularly in coastal areas, the advantage of a collection device according to this description having only a small draft is of great advantage, since very quickly an entire coastal region can be cleaned before the contaminants pollute the coastline itself.

BRIEF DESCRIPTION OF THE DRAWINGS

Exemplary embodiments of the invention will be explained in detail with reference to the accompanying drawings.

In the drawings.

DETAILED DESCRIPTION OF THE INVENTION

Figure 1:
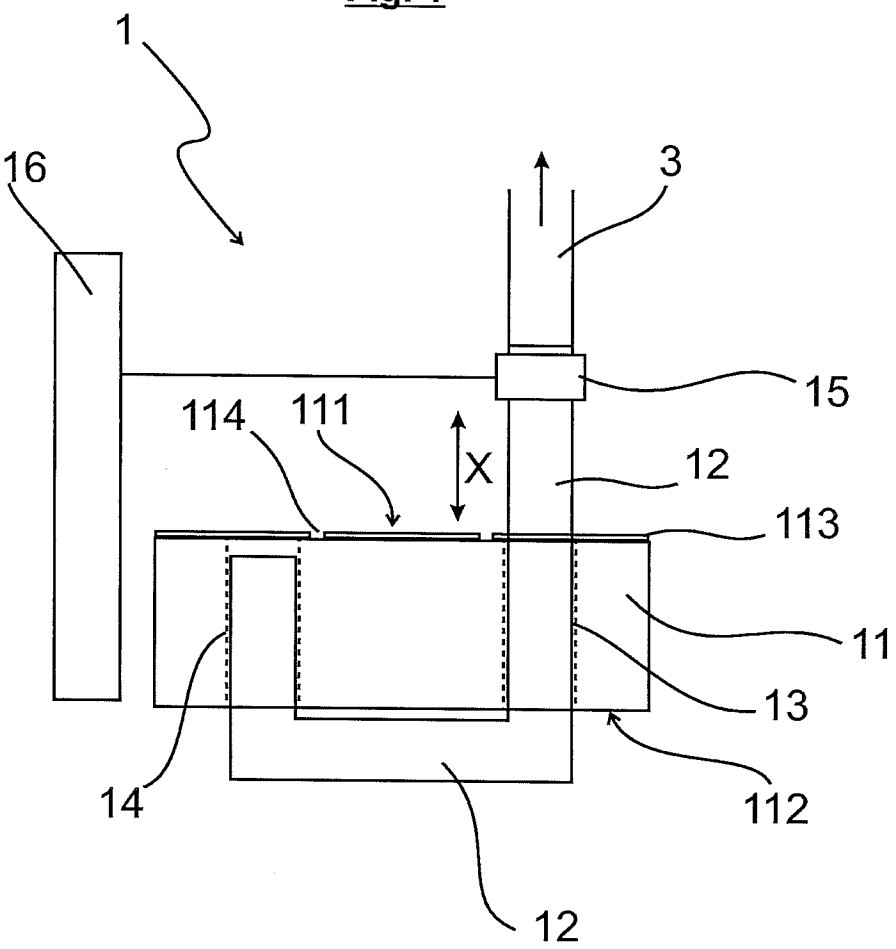
FIG. 1 is a schematic representation of a first embodiment of the inventive suction float.

In FIG. 1 a schematic representation of a first embodiment of the inventive suction float 1 is shown.

The suction float 1 includes a float 11 having an underside 112 and an upper surface 111. A first 13 and a second passageway 14 respectively penetrate through the float from the upper surface to the underside.

The suction float 1 further comprises a suction pipe section 12. This suction pipe section 12 enters through the upper surface 111 and extends through the first passage 13 and then extends along the underside 112. Subsequently, the suction pipe section 12 is arranged to penetrate into the second passage 14 of the floating body 11 from the underside 112.

With the aid of the suction pipe section 12 a removal of liquids 2 and/or contaminants 22 occurs, which flow via the second passage 14 into the suction pipe section 12 and then to suction pipe 3 connected to the other end of suction pipe section 12 for further transport.

A stop 15 is provided on the suction pipe section 12 which limits movement in the direction X of the floating body 11. At this stop 15, a holder is arranged with a deflector plate or baffle 16. The baffle 16 is at least partially arranged in front of or around the float 11, and serves to protect the floating body 11 from the pressures of impinging large amounts of liquid 2. The baffle 16 can also be arranged on the floating body 11 itself. However, locating it to another component of the suction float 1 is preferable because a weight saving and protection against unwanted forces on the floating body 11 is effected. The height of the baffle 16 is to be adjusted such that a protection over the entire stroke of the floating body is possible.

The stop 15 can also be realized differently. For example, a limit can be provided within the floating body that prevents too far a movement of the floating body 11 beyond the end of the suction pipe sections 12 out of the second passage 14.

At the upper surface of the floating body 11, a rim 113 is provided, which is provided with notches or indentations 114.

The first 13 and second passages 14 are dimensioned such that they can each accommodate suction pipe section 12. For this purpose the suction pipe section 12 can particularly preferably be made round. However, other shapes are also possible, wherein the respective cross-sections are identical in shape and size.

The float 11 can adapt to different liquid levels by a free moving along the suction pipe sections 12, wherein the motion is in the direction X.

In the following the same reference numerals are used as in FIG. 1 for like elements. For their basic function, reference is made to FIG. 1.

Figure 2:
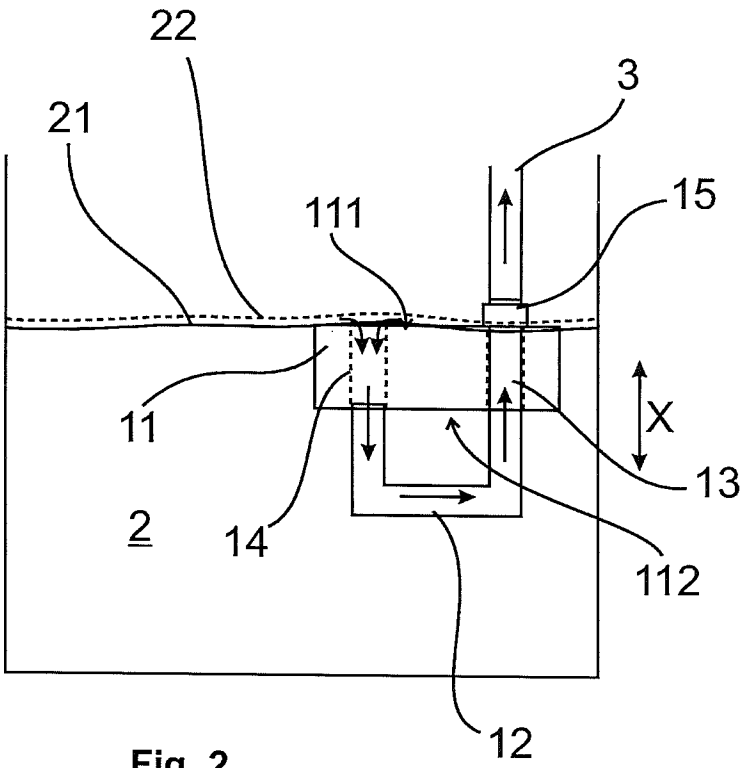
FIG. 2 is a schematic representation of a second preferred embodiment of the suction float of the invention used in a container.

In FIG. 2 a schematic representation of a second embodiment of the inventive suction float 1 is shown in use in a container. The container is, for example, a tank, a working vessel, a pool, ponds, lakes, rivers, oceans, or the like.

The suction float 1 is at this time freely arranged in the container with the aid of the at least relatively stationary suction pipe 3 and the thereto connected suction pipe section 12. In the container 2 there is a liquid 21 having a surface on which are liquid and/or foam-type impurities 22.

In the state illustrated, the floating body 11 is limited in its' maximum upward deflection by abutment 15. This also constitutes the maximum liquid level in the container. For higher liquid levels, however, the floating body 11 can be made higher and/or the suction pipe section 12 which penetrates in the second passage 14 can be made longer so as to realize a larger stroke of the floating body 11.

The contaminants 22 are sucked from the surface 21 of the liquid 2, through the second passage 14 from the upper surface 111 of the floating body 11, and further transported through the suction pipe section 12 along the underside 112 of the floating body 11, and subsequently by the suction pipe section 12 through the first passage 13 of the floating body 11 and then continue to be transported through the suction pipe 3. This is shown by the arrows within the suction pipe sections 12 or suction pipe 3.

Since the upper surface 111 of the float 11 is always at the surface 21 of the liquid 2 as a result of the buoyancy of the floating body 11, only the impurity 22 is almost exclusively removed, which results in an overall high efficiency of the collecting device. In particular, with changing liquid levels a self-adaptation of the float 11 follows in the direction X.

The suctioning off of the impurities 22 occurs, according to the invention, by conventional pumping and/or suction systems, as are known in the art. The extracted contaminants 22 are almost free of liquid 2, so that they can be accordingly easily disposed of or stored.

Figure 3:
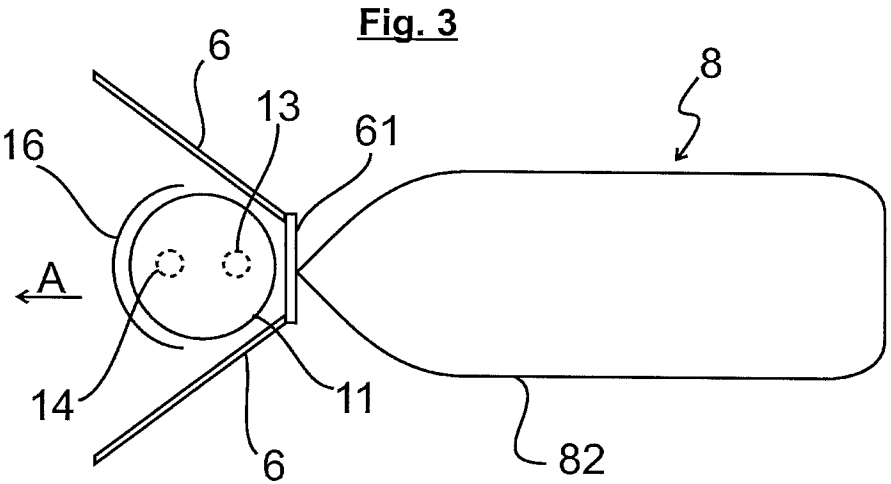
FIG. 3 is a schematic representation of a third embodiment of the inventive suction floats in use on a ship in a top view.

FIG. 3 shows a schematic representation of a third embodiment of the inventive suction float 1 is shown in use on a ship 8 in a plan view.

There is shown a plan view of the floating body 11. The first 13 and the second passages 14 are shown. In general the arrangement of the first 13 and second passage 14 may also be reversed so that depending on the design and implementation, viewed in the direction of A, a pushed (FIG. 3) or pulled (13 and 14 reversed) suction float 1 is realized. The suction float 1 is fastened to the ship 8 via the passage of the suction pipe section 12 and the suction pipe 3 through the first passage 13.

Further, a support 61 is attached to the ship 8, and more particularly to the ship's hull 82, which is mounted either fixedly or detachably and variable and adaptable. When the support 61 is configured variably adjustable and detachable, the support 61 can be mated to different vessels with different bow shapes, e.g., be placed on the hull or on the hull and on deck. The support 61 serves for receiving baffles 6. The baffles 6 effectively increase the working width and guide the targeted impurities 22 to the suction float 1, so that they 22 can be removed there.

In the working direction A, a baffle plate is provided in front of the float 11, which keeps the wave action and the water pressure generated by the driving operation of the ship 8 away from the floating body 11 so that it 11 can move in the direction X freely.

Figure 4:
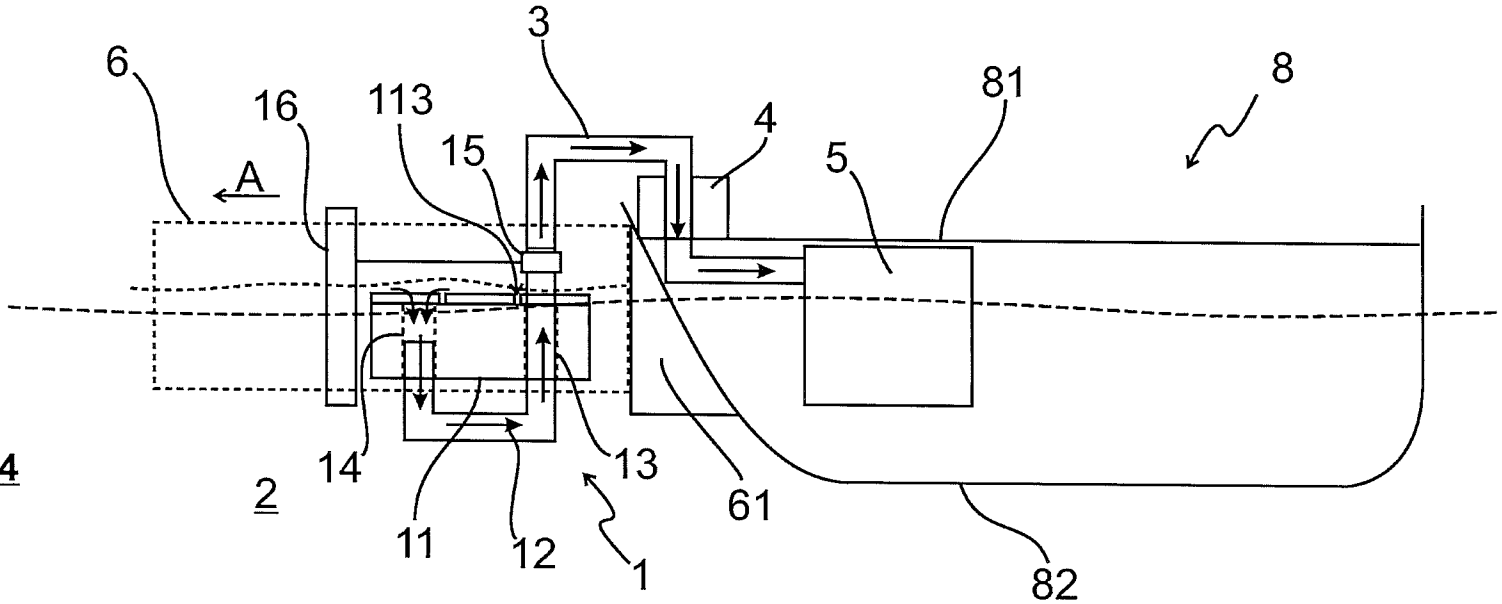
FIG. 4 is a schematic illustration of the third embodiment of the inventive suction float or collection device in use on a ship in a side view.

FIG. 4 shows a schematic representation of the third embodiment of the invention. Suction float 1 and the collection device in use with a ship 8 is shown in a side view.

A changing water level is shown in dashed line. The floating body 11 continuously adapts to these water level, so that the upper surface surface 111 of the floating body 11 is always located at the surface 21 of the water 2. In the instant shown, the float 11 is located approximately in the middle of its possible travel space, so that this can still continue to move upward or downward. The ship 8, on which the suction float 1 is arranged, behaves in relation to the changing waterline quite relatively calmly and keeps a nearly constant relative position.

At this point, the basic operating principle illustrated in FIGS. 1, 2 and 3 is referred to. Essentially only the further processing or treatment is illustrated here, namely, a suction device 4 on deck 81 or in the hull 82 of the ship 8, and a separator 5 is arranged here in the hull 82 of the ship 8. Subsequent to the separator 5, storage tanks, not shown here, can be provided that can be filled with removed contaminants 22 to be later pumped, for example, to land storage tanks, transportation vehicles or at sea to another vessel as required.

The guide plates 6, which are preferably made of a durable material, such as reinforced plastic, coated steel or stainless steel, increasing the work surface. For this purpose the guide plates 6 are configured such that their height covers the entire possible operating range of the floating body 11.

For clarity of overview, the representation of impurities has been omitted. The baffles 6 capture the contaminants present on the surface 22 and forward them to the suction float 1, where they are removed accordingly.

The float 11 has a rim with notches or indentations 114, 113 in one specific embodiment. This again increase the efficiency of the pre-separation and improves the delivery to the float 11.

Figure 5:
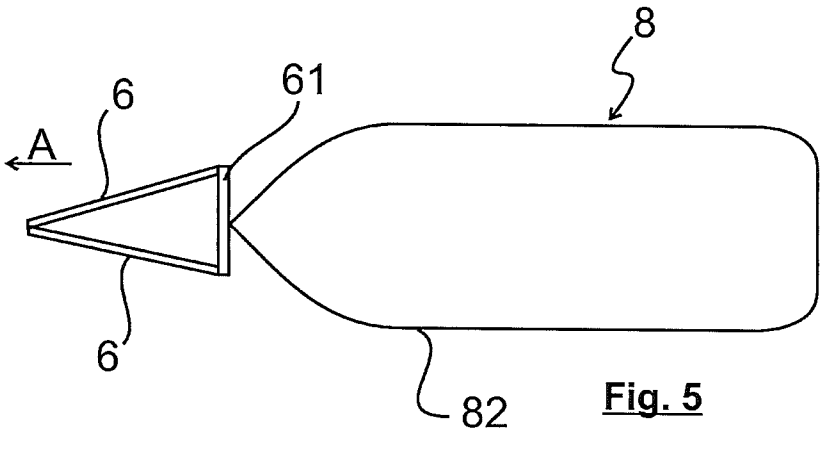
FIG. 5 is a schematic illustration of the third embodiment of the collection device of the invention on a ship in a top view in a travel mode.

FIG. 5 shows a schematic illustration of the third embodiment of the collection device according to the invention with a ship 8 in a plan view in a travel mode.

In addition to the working mode, the ship 8 can be operated in a travel mode. For this purpose, for example the suction float 1 tilted up and the guide plates 6 are folded together to an acute triangle so that an upstream second bow is formed. This allows the ship 8 to be operated with normal cruising speed, even though a collection device is provided.

LIST OF REFERENCE NUMERALS

1 suction float
11 float
111 upper surface
112 underside
113 rim
114 notches or indentations
12 suction pipe section
13 first passage
14 second passage
15 stop
16 baffle
2 liquid
21 surface
22 contamination
3 suction pipe
4 suction device
5 separator
6 baffles
61 support
7 mount/bracket

8 ship
81 deck
82 hull
A direction of operation
X direction of movement

The invention claimed is:

1. A suction float (1) for the removal of liquid and/or foam-type impurities (22) from surfaces (21) of liquids (2) comprising:

a suction pipe section (12) for transport of aspirated liquid (2) and/or impurities (22), and a floating body (11) having an upper surface (111) and an underside (112), a first passage (13) through the floating body (11) from the upper surface (111) to the underside (112) of the floating body (11) for passage through of the suction pipe section (12) and a second passage (14) through the floating body (11) from the underside (112) to the upper surface (111) of the floating body (11), wherein the suction pipe section (12) after passage through the first passage (13) through the floating body (11) extends along the underside (112) of the float (11) and penetrates into the second passage (14) in the floating body (11), and wherein the floating body (11) is movable (X) along the suction pipe section (12).

2. The suction float (1) according to claim 1, wherein the outer diameter of the suction pipe section (12) is less than or equal to the inner diameter of the first (13) and/or second passage (14).

3. The suction float (1) according to claim 1, wherein a stop (15) is provided on suction pipe section (12) for limiting the freedom of movement (X) of the float (11).

4. The suction float (1) according to claim 1, wherein a baffle plate (16) is provided at suction pipe section (12) and is at least partially protective of the floating body.

5. The suction float (1) according to claim 4, wherein the baffle plate (16) is provided upstream in the working direction (A) and/or about the floating body (11).

6. The suction float (1) according to claim 1, wherein the upper surface (111) of the float (11) is funnel-shaped and/or wherein a rim (113) is arranged on the upper side (111).

7. A collection means for collecting liquid and/or foam-type impurities (22) from surface (21) of liquid (2), comprising a suction float (1) according to claim 1, a suction device (4) and/or a separating device (5), a suction pipe (3) downstream of the suction pipe section (12) for transport of extracted impurities (22) and/or liquid (2) to the suction device (4) and/or separating device (5), a support for fixing baffles adapted to guide the impurities 22 to the suction float 1, and a suction device (4) and/or a separating device (5), wherein the liquid and/or foam-type impurities (22) are extracted from the surface (21) of the liquid (2) via the suction float (1) by the suction device (4) and/or are separated with the aid of the separating device (5).

8. The collection device according to claim 7, wherein feed means are provided for guiding the liquid and/or foam-type impurities (22) on the surface (21) of the liquid (2) to the suction float (1).

9. The collection device according to claim 8, wherein the feed means are two baffles (6) extending through the surface (21) of the liquid.

10. A collecting ship (8) comprising a collecting device as claimed in claim 7, wherein the suction float (1) is connected to the ship (8).

11. The collecting ship according to claim 10, wherein two guide plates (6) extending through the surface (21) of liquid (2) are provided on the vessel (8) at a common point of attachment, wherein these form in the operating mode an at least approximately V-shaped layout open in the operating direction (A), and wherein the suction float (1) is arranged in the middle of two guide plates (6.

12. The collecting ship according to claim 11, wherein two guide plates (6) extending through the surface (21) of liquid (2) are provided on the vessel (8) at a common point of attachment via an adjustable holder (61) fastened on the hull (82).

13. The collecting ship according to claim 11, wherein a baffle plate (16) is arranged on the side of the suction float (1) facing away from the common point of attachment.

14. The collecting ship (8) according to claim 10, wherein the suction float (1) is connected to the ship (8) with the suction pipe (3) secured to the ship deck (81) and/or on the hull (82) by a fastening and/or holding device (7).

15. The suction float (1) according to claim 1, wherein a rim (113) with notches or indentations (114) is arranged on the upper side (111) of the float (11).

* * * * *